US009816766B2

(12) United States Patent
Miller et al.

(10) Patent No.: US 9,816,766 B2
(45) Date of Patent: Nov. 14, 2017

(54) TWO PIECE MANIFOLD

(71) Applicant: Hamilton Sundstrand Corporation, Windsor Locks, CT (US)

(72) Inventors: Matthew William Miller, Enfield, CT (US); Anthony DeLugan, Feedings Hills, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 184 days.

(21) Appl. No.: 14/705,722

(22) Filed: May 6, 2015

(65) Prior Publication Data

US 2016/0327349 A1 Nov. 10, 2016

(51) Int. Cl.

| | |
|---|---|
| ***F28F 9/02*** | (2006.01) |
| ***F28D 1/053*** | (2006.01) |
| ***F28F 9/18*** | (2006.01) |
| ***F28D 9/00*** | (2006.01) |

(52) U.S. Cl.

CPC ..... *F28F 9/02* (2013.01); *F28D 1/05391* (2013.01); *F28D 9/0093* (2013.01); *F28F 9/0204* (2013.01); *F28F 9/0221* (2013.01); *F28F 9/0224* (2013.01); *F28F 9/182* (2013.01)

(58) Field of Classification Search

CPC .... F28D 1/05391; F28F 9/0202; F28F 9/0221

USPC ..... 165/174, 175, 176

See application file for complete search history.

(56) References Cited

U.S. PATENT DOCUMENTS

| | | | | |
|---|---|---|---|---|
| 3,731,736 | A * | 5/1973 | Fernandes | F28D 9/0081 165/143 |
| 3,907,032 | A * | 9/1975 | DeGroote et al. | F28D 1/05366 165/143 |
| 5,318,114 | A * | 6/1994 | Sasaki | F28D 1/035 165/109.1 |
| 5,445,219 | A | 8/1995 | Hutto et al. | |
| 5,941,303 | A | 8/1999 | Gowan et al. | |
| 6,082,448 | A * | 7/2000 | Haussmann | F28D 1/05391 165/158 |
| 6,446,713 | B1 | 9/2002 | Insalaco | |
| 6,568,466 | B2 * | 5/2003 | Lowenstein et al. | F28D 5/00 165/153 |
| 6,736,203 | B2 | 5/2004 | Rhodes et al. | |
| 7,472,744 | B2 | 1/2009 | Gorbounov et al. | |

(Continued)

FOREIGN PATENT DOCUMENTS

| | | | | |
|---|---|---|---|---|
| EP | 1780489 | A1 | 5/2007 | |
| JP | WO 2014091747 | A1 * | 6/2014 | F28F 9/0221 |

(Continued)

*Primary Examiner* — Allen Flanigan

(74) *Attorney, Agent, or Firm* — Kinney & Lange, P.A.

(57) ABSTRACT

A manifold for a heat exchanger assembly includes a body with a first end disposed opposite a second end, and a top surface disposed opposite a bottom surface. A first side surface extends between the top and bottom surfaces, and a second side surface extends between the top and bottom surfaces opposite the first side surface. A first plurality of chambers is formed in the body with each chamber of the first plurality of chambers being spaced apart from one another between the first end and the second end of the body. A second plurality of chambers is formed in the body with each chamber of the second plurality of chambers being spaced apart from one another between the first end and the second end of the body.

14 Claims, 5 Drawing Sheets

(56) References Cited

U.S. PATENT DOCUMENTS

| | | | | |
|---|---|---|---|---|
| 7,562,697 | B2 | 7/2009 | Gorbounov et al. | |
| 7,578,340 | B2 * | 8/2009 | Forster et al. | F28D 1/05366 165/153 |
| 7,967,061 | B2 | 6/2011 | Gorbounov et al. | |
| 8,235,101 | B2 | 8/2012 | Taras et al. | |
| 8,851,158 | B2 | 10/2014 | Alahyari et al. | |
| 2005/0103486 | A1 * | 5/2005 | Demuth et al. | F28D 1/0478 165/174 |
| 2005/0235691 | A1 * | 10/2005 | Katoh et al. | F25B 39/02 62/515 |
| 2006/0124289 | A1 * | 6/2006 | Shinmura | F28D 1/05391 165/176 |
| 2006/0162917 | A1 * | 7/2006 | Park et al. | F28F 9/0278 165/175 |
| 2008/0229580 | A1 | 9/2008 | Anderson et al. | |
| 2010/0147501 | A1 | 6/2010 | Art et al. | |
| 2010/0270012 | A1 | 10/2010 | Hur et al. | |
| 2011/0174472 | A1 | 7/2011 | Kurochkin et al. | |
| 2012/0204595 | A1 * | 8/2012 | Tamaki et al. | F28D 1/05391 62/498 |
| 2013/0081795 | A1 | 4/2013 | Janezich et al. | |
| 2014/0293540 | A1 | 10/2014 | Doe et al. | |

FOREIGN PATENT DOCUMENTS

| | | | |
|---|---|---|---|
| WO | 9923432 | A1 | 5/1999 |
| WO | 2005124259 | A1 | 12/2005 |
| WO | 2007028542 | A1 | 3/2007 |

* cited by examiner

TWO PIECE MANIFOLD

BACKGROUND

This disclosure relates generally to heat exchangers, and more particularly, to manifolds and headers for a mini- or micro-channel heat exchanger assembly.

Manifolds and headers used in multi-row mini- or micro-channel heat exchangers impart multiple manufacturing challenges. Mini-channel heat exchangers require manifolds or headers that are strong enough to withstand the elevated pressures exerted by fluids flowing through the manifolds or headers during operation. Typically, the headers are made from roll-formed, welded or hydroformed sheet metal. The manifolds are generally formed by extrusion or casting followed by subsequent machining. Generally, when manufacturing a manifold or header, multiple plugs must be brazed to the header to close any undesired openings in the header. Each brazing step required to manufacture the manifold or header significantly increases the labor cost to manufacture the manifold or header.

SUMMARY

In one aspect of the invention, a manifold for a heat exchanger assembly includes a body and a plate. The body includes a first end disposed opposite a second end, and a top surface disposed opposite a bottom surface. The body also includes a first side surface extending between the top surface and the bottom surface, and a second side surface extending between the top surface and the bottom surface opposite the first side surface. A first plurality of chambers are formed in the body such that each chamber of the first plurality of chambers extends from the top surface to the bottom surface and extends between the first side surface and an intermediate plane disposed between the first side surface and the second side surface. Each chamber of the first plurality of chambers is also spaced apart from one another between the first end and the second end of the body. A second plurality of chambers is also formed in the body. Each chamber of the second plurality of chambers extends from the top surface to the bottom surface and extends between the second side surface and the intermediate plane. Each chamber of the second plurality of chambers is also spaced apart from one another between the first end and the second end of the body. The plate is disposed on the top surface of the body.

In another aspect of the invention, a manifold for a heat exchanger assembly includes a body having a first end disposed opposite a second end and a top surface disposed opposite a bottom surface. The body further includes a first side surface extending between the top surface and the bottom surface and a second side surface extending between the top surface and the bottom surface opposite the first side surface. A first plurality of chambers is formed in the body such that each chamber of the first plurality of chambers extends from the bottom surface towards the top surface and extends between the first side surface and an intermediate plane disposed between the first side surface and the second side surface. Each chamber of the first plurality of chambers is also spaced apart from one another between the first end and the second end of the body. A second plurality of chambers is also formed in the body. Each chamber of the second plurality of chambers extends from the bottom surface towards the top surface and extends between the second side surface and the intermediate plane. Each chamber of the second plurality of chambers is also spaced apart from one another between the first end and the second end of the body.

Persons of ordinary skill in the art will recognize that other aspects and embodiments of the present invention are possible in view of the entirety of the present disclosure, including the accompanying figures.

Figure 1:
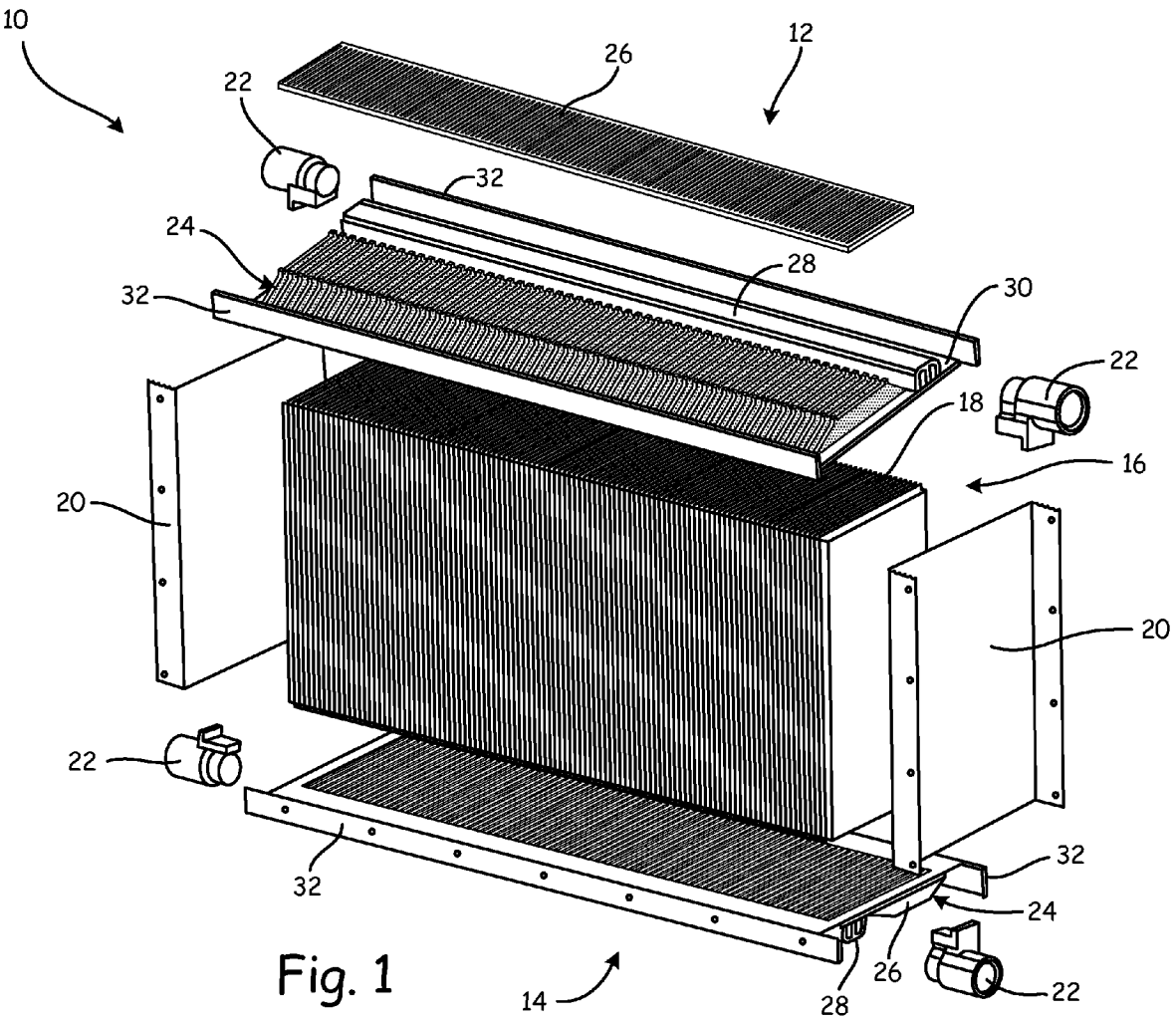
FIG. 1 is a perspective exploded view of a heat exchanger assembly.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

The present disclosure provides a two-piece manifold for a mini-channel heat exchanger. The manifold includes at least two rows of chambers, with each chamber connected to no more than two mini-channel tubes. Because the manifold only includes two pieces, the manifold only requires one brazing step during manufacturing, thereby requiring a lower manufacturing cost in comparison to prior art heat exchanger manifolds and headers. As described below with reference to the Figures, heat exchanger assemblies that incorporate the present manifold are also relatively lighter than heat exchangers that incorporate prior art manifolds or headers because the present manifold requires significantly less fluid volume during operation than prior art manifolds and headers due to the chambers of the present manifold being connected to no more than two mini-channel tubes.

FIG. 1 is a perspective exploded view of heat exchanger assembly 10. As shown in FIG. 1, heat exchanger assembly 10 can include first manifold 12, second manifold 14, heat exchanger core 16 having a plurality of mini-channel tubes 18, two end panels 20, and fittings 22. Each of manifolds 12 and 14 can include body 24, plate 26, fluid channel 28, base plate 30, and side flanges 32.

First manifold 12 is disposed opposite second manifold 14 such that a bottom surface of manifold 12 faces a bottom surface of second manifold 14. Heat exchanger core 16 is disposed between first manifold 12 and second manifold 14 such that mini-channel tubes 18 of heat exchanger core 16 also extend in length between first manifold 12 and second manifold 14 and are fluidically connected to both first manifold 12 and second manifold 14. As shown in FIG. 1, first manifold 12 and second manifold 14 can be identical, symmetrical, or mirror symmetric to one another. Thus, the description of first manifold 12 can also describe second manifold 14. The description below will primarily focus on first manifold 12, though the description will apply to both first manifold 12 and second manifold 14.

Base plate 30 of first manifold 12 can generally be rectangular, and side flanges 32 can be connected to at least two sides of base plate 30 and can extend obliquely from base plate 30. Body 24 and fluid channel 28 of first manifold 12 can extend from base plate 30 opposite the bottom side of first manifold 12 and opposite air fine core 16. Body 24, fluid channel 28, base sheet 30, and side flanges 32 of first manifold 12 can all be formed as a single, integral, extruded piece, or as a single, integral, casted piece. Plate 26 can be a separate component from body 24 and can be brazed to body 24 of first manifold 12.

Two end panels 20 can extend between first manifold 12 and second manifold 14 with heat exchanger core 16 being disposed between end panels 20. Both end panels 20 are connected to side flanges 32 of first manifold 12 and side flanges 32 of second manifold 14. End panels 20, along with first manifold 12 and second manifold 14, can form a supportive frame for heat exchanger assembly 10. Two of fittings 22 are connected to fluid channel 28 of first manifold 12, with one of fittings 22 connected to each end of fluid channel 28 of first manifold 12. Two fittings 22 are also connected to fluid channel 28 of second manifold 14, with one of fittings 22 connected to each end of fluid channel 28 of second manifold 14. During operation, pressurized fluid can enter heat exchanger assembly 10 through fittings 22 connected to fluid channel 28 of first manifold 12. After traveling through mini-channel tubes 18 of heat exchanger core 16, the pressurized fluid can exit heat exchanger assembly 10 through fittings 22 connected to fluid channel 28 of second manifold 12.

First manifold 12 and second manifold 14 can be formed from aluminum alloy 6063, or any other metal or material that possess the necessary strength and thermal properties to withstand the operating pressures and temperatures of heat exchanger assembly 10. Mini-channel tubes 18 of heat exchanger core 16 can be formed from aluminum alloy 31104, or any other metal or material that possess the necessary strength to withstand the operating pressures of heat exchanger assembly 10 and the necessary thermal conductivity to meet the heat transfer requirements of heat exchanger assembly 10. Air fins connected to mini-channel tubes 18 can be formed from aluminum alloy 6951 or any other metal or material that possess the necessary thermal conductivity to meet the heat transfer requirements of heat exchanger assembly 10. First manifold 12 and second manifold 14 are discussed in greater below with reference to FIGS. 2A-5.

Figure 2A:
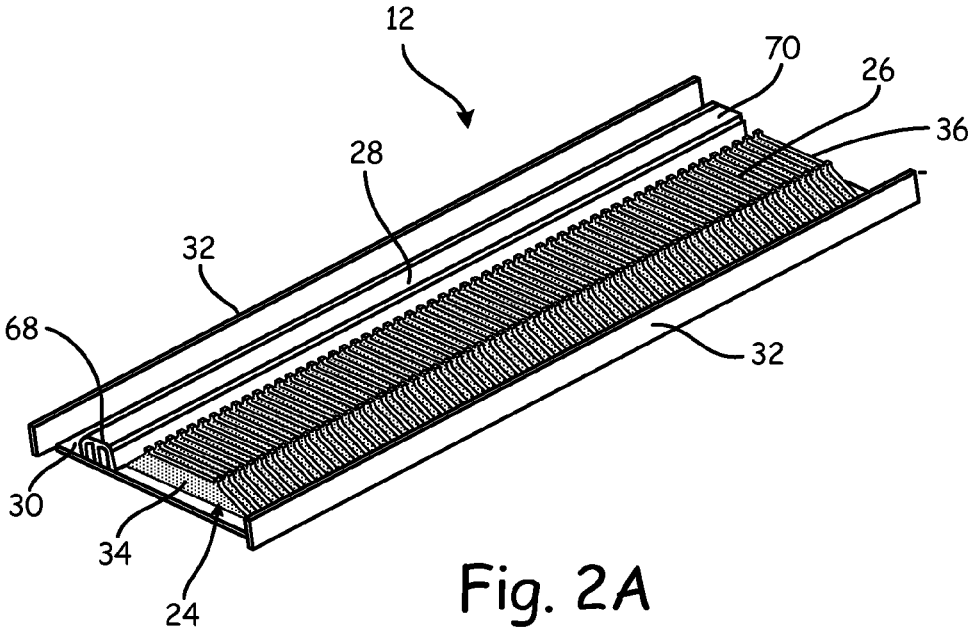
FIG. 2A is a perspective view of a manifold from the heat exchanger assembly of FIG. 1.
Figure 2B:
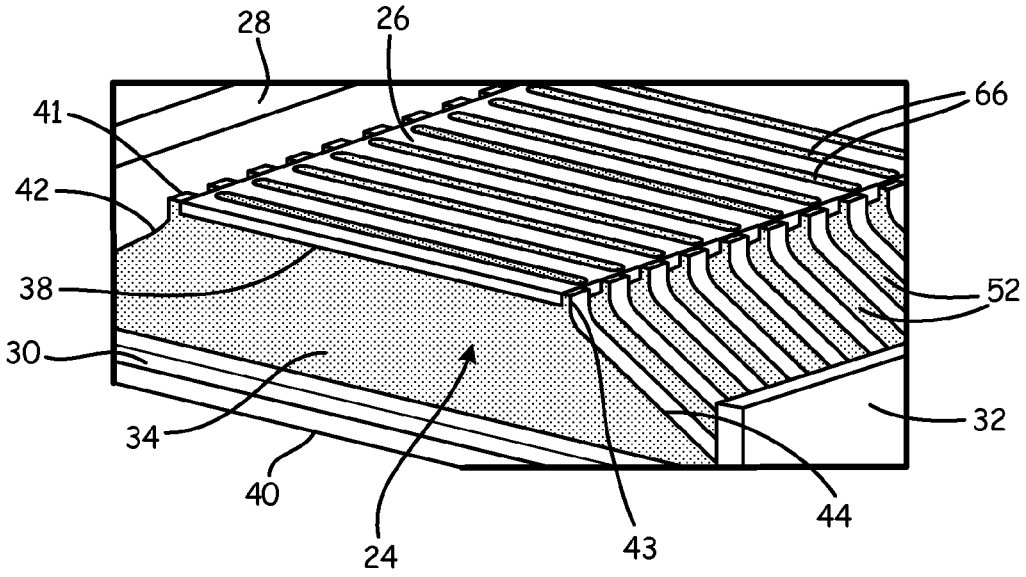
FIG. 2B is an enlarged perspective view of the manifold from FIG. 2A.
Figure 3:
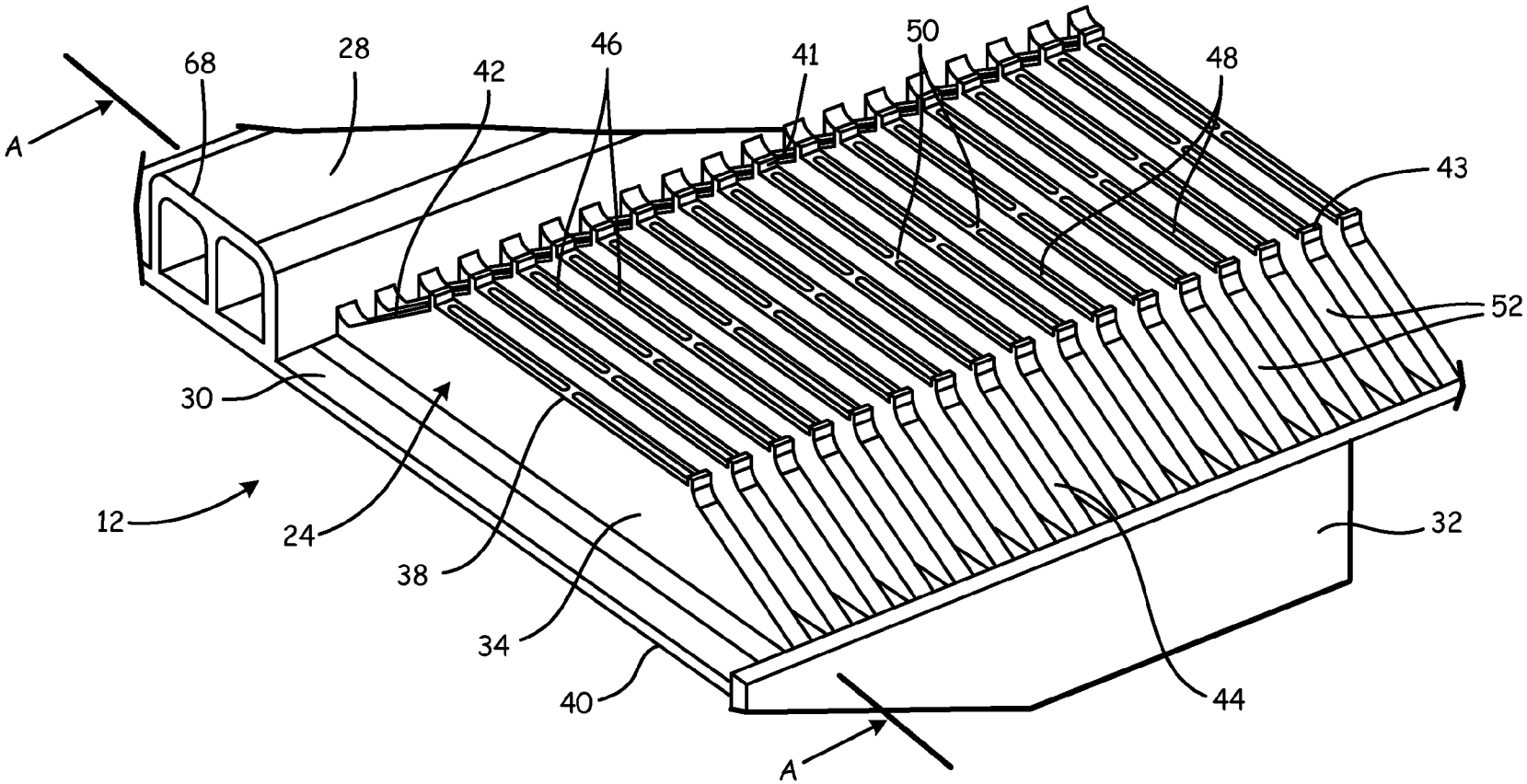
FIG. 3 is an enlarged perspective view of the manifold from FIG. 2A with a plate removed.
Figure 4:
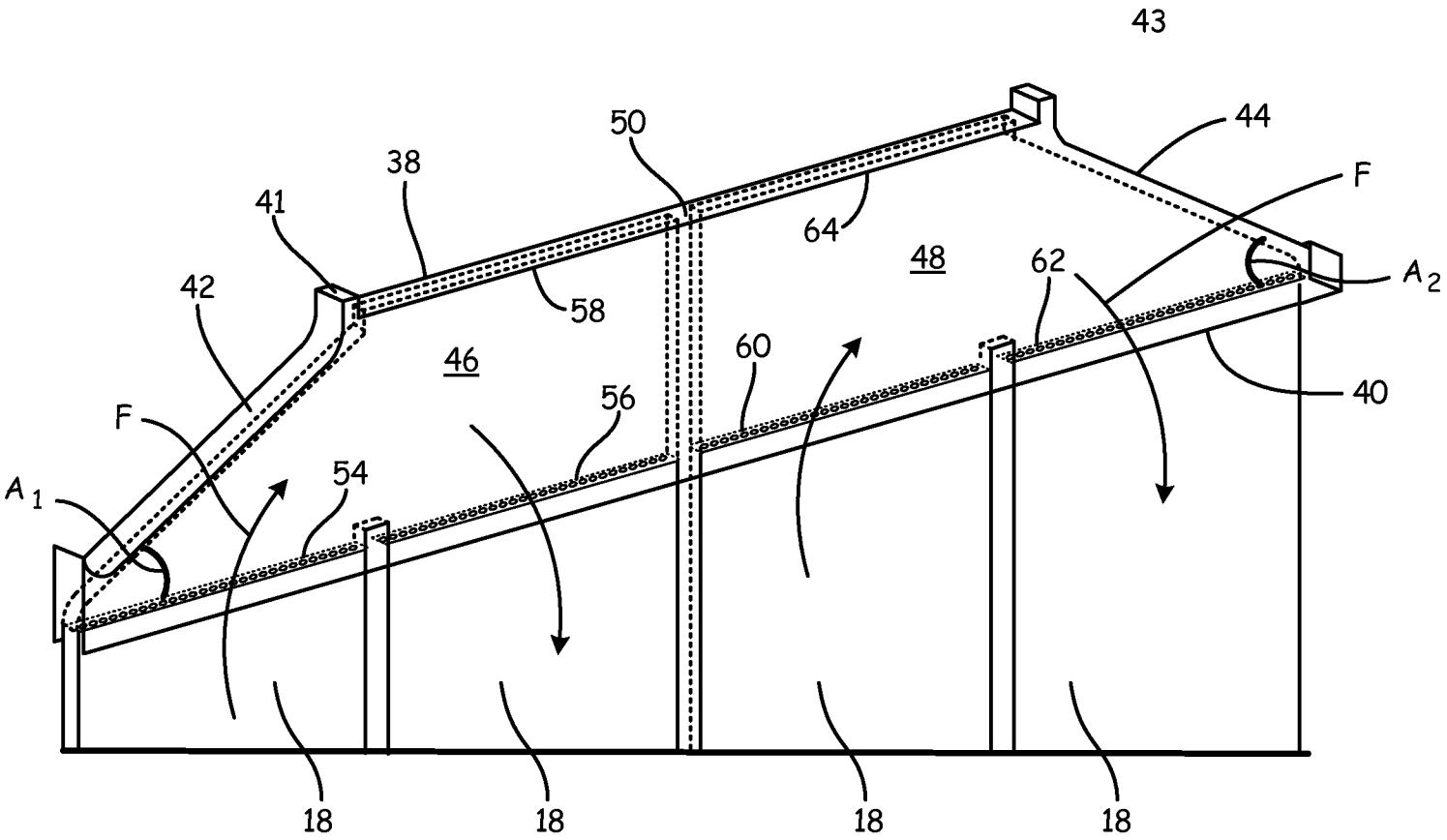
FIG. 4 is a cross-sectional view of the manifold of FIG. 3 taken along line A-A and a plurality of heat exchanger tubes connected to the manifold.
Figure 5:
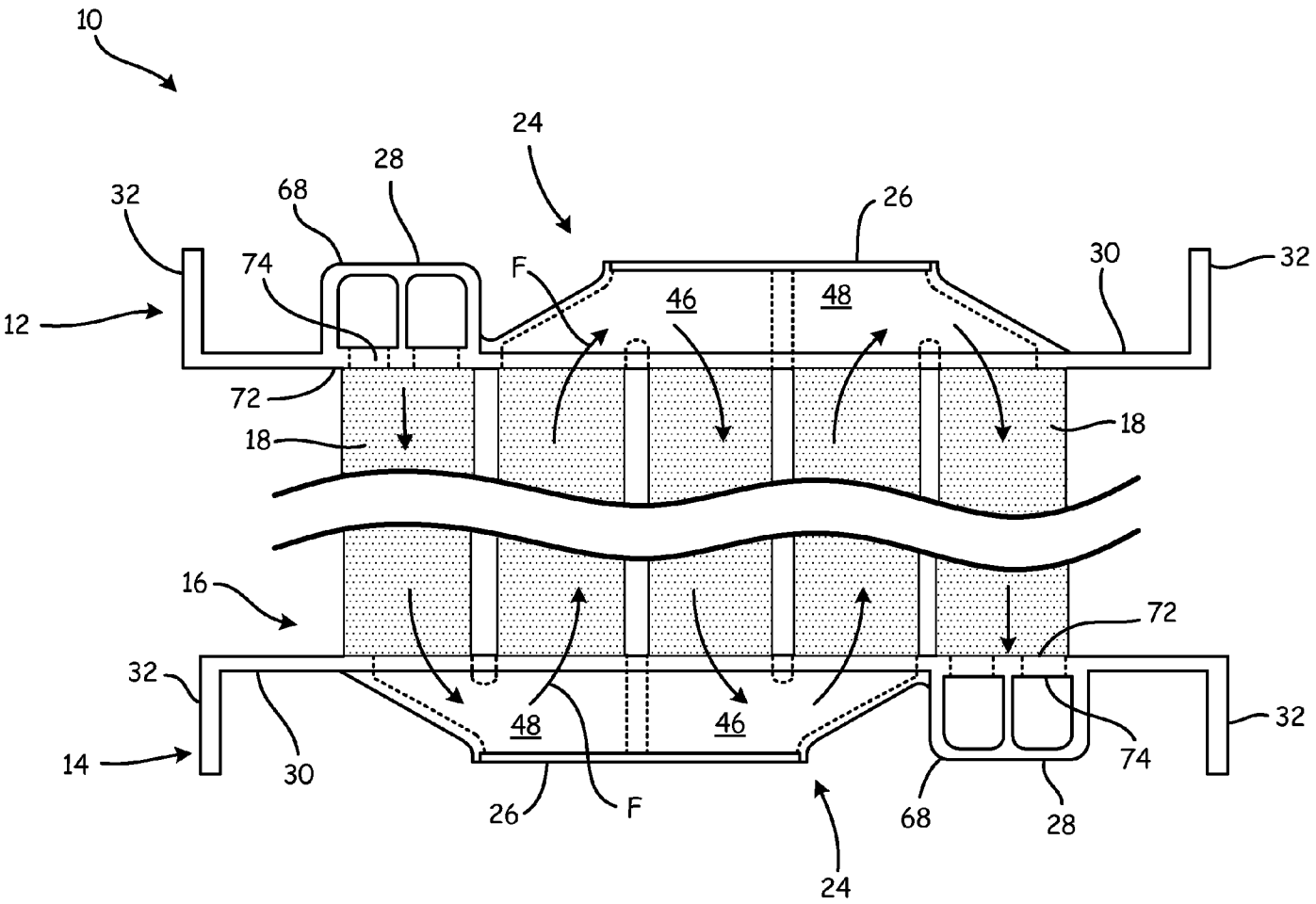
FIG. 5 is an end elevation view of the heat exchanger assembly from FIG. 1.

FIGS. 2A-5 will be discussed concurrently. FIG. 2A is a perspective view of first manifold 12 from heat exchanger assembly 10 of FIG. 1. FIG. 2B is an enlarged perspective view of first manifold 12 from FIG. 2A, and FIG. 3 is an enlarged perspective view of first manifold 12 from FIG. 2A with plate 26 removed. FIG. 4 is a cross-sectional view of first manifold 12 of FIG. 3 taken along line A-A and also showing mini-channel tubes 18 connected to first manifold 12. FIG. 5 is an end elevation view of heat exchanger assembly 10 from FIG. 1. As previously discussed with reference to FIG. 1, first manifold 12 and second manifold 14 can be identical, thus, while the description below will be primarily directed to first manifold 12, the description of first manifold 12 can also be equally applied to describe second manifold 14.

As shown in FIGS. 2A-5, body 24 of first manifold 12 can include first end 34, second end 36, top surface 38, bottom surface 40, first side surface 42, second side surface 44, a first plurality of chambers 46, a second plurality of chambers 48, partitions 50, and grooves 52. Each chamber 46 of the first plurality of chambers 46 can include first opening 54, second opening 56, angle $A_1$, and top opening 58. Each chamber 48 of the second plurality of chambers 48 can include first opening 60, second opening 62, angle $A_2$, and top opening 64. Plate 26 of first manifold 12 can include slots 66. Fluid channel 28 of first manifold 12 can include first end 68, second end 70, bottom surface 72, and a plurality of openings 74.

First end 34 of body 24 is disposed opposite second end 36 of body 24. Top surface 38 of body 24 can extend from first end 34 to second end 36 of body 24 and is disposed opposite bottom surface 40 of body 24. Top surface 38 can be parallel to bottom surface 40. As shown in FIGS. 2A-5, bottom surface 40 of body 24 can be continuous with a bottom surface of base plate 30 of first manifold 12. First side surface 42 of body 24 extends between top surface 38 and bottom surface 40 of body 24, and can also extend from first end 34 to second end 36 of body 24. Second side surface 44 extends between top surface 38 and bottom surface 40 of body 24 opposite first side surface 42, and can also extend from first end 34 to second end 36 of body 24. As shown in FIGS. 2A-5, bottom surface 40 of body 24 can be larger in width than top surface 38 and centered under top surface 38 such that top surface 38, bottom surface 40, first side surface 42, and second side surface 44 cause body 24 to have an extruded trapezoid-shaped profile.

As shown best in FIG. 2B, first ridge 41 can be formed on top surface 38 where first side surface 42 meets top surface 38. First ridge 41 can also extend from first end 34 to second end 36 of body 24. Second ridge 43 can be formed on top surface 38 where second side surface 44 meets top surface 38. Similar to first ridge 41, second ridge 43 can extend from first end 34 to second end 36 of body 24. Plate 26 is disposed on top surface 38 of body 24 between first ridge 41 and second ridge 43 and can extend from first end 34 to second end 36 of body 24. During the assembling of first manifold 12, first ridge 41 and second ridge 43 can aid in positioning plate 26 on top surface 38 of body 24 as plate 26 is attached to body 24, such as by brazing or welding.

Before plate 26 is brazed to body 24, the first plurality of chambers 46 and the second plurality of chambers 48 can both be formed in body 24. As shown best in FIGS. 3-4, the first plurality of chambers 46 is formed in body 24 such that each chamber 46 of the first plurality of chambers 46 extends from top surface 38 to bottom surface 40 of body 24. Each chamber 46 of the first plurality of chambers 46 also extends between first side surface 42 and an intermediate plane disposed between first side surface 42 and second side surface 44. As shown in FIG. 3, each chamber 46 of the first plurality of chambers 46 is spaced apart from one another between first end 34 and second end 36 of body 24 such that chambers 46 are aligned in a single row that extends between first end 34 and second end 36.

The second plurality of chambers 48 are also formed in body 24. Each chamber 48 of the second plurality of chambers 48 extends from top surface 38 of body 24 to bottom surface 40 of body 24. Each chamber 48 of the second plurality of chambers 48 also extends between second side surface 44 and the intermediate plane disposed between first side surface 42 and second side surface 44. As shown in FIG. 3, the intermediate plane can also be described as a reference plane disposed between the second plurality of chambers 48 and the first plurality of chambers 46. Similar in fashion as the first plurality of chambers 46, each chamber 48 of the second plurality of chambers 48 is spaced apart from one another between first end 34 and second end 36 of body 24 such that chambers 48 are aligned in a second single row that extends between first end 34 and second end 36.

Each chamber 46 of the first plurality of chambers 46 can be aligned with one of the second plurality of chambers 48 between first side surface 42 and second side surface 44. Partitions 50 can be formed on the intermediate plane between the first plurality of chambers 46 and the second plurality of chambers 48 and can physically separate and fluidically isolate the first plurality of chambers 46 from the second plurality of chambers 48 in first manifold 12. Grooves 52 can be formed in top surface 38 of body 24 such that each groove 52 extends from first side surface 42 to second side surface 44 and intersects top surface 38, first side surface 42, second side surface 44, first ridge 41, and second ridge 43. As shown best in FIG. 3, each one of grooves 52 can be disposed between two chambers 46 of the first plurality of chambers 46 and two chambers 48 of the second plurality of chambers 48. While grooves 52 are disposed between individual chambers 46 and chambers 48, grooves 52 do not intersect any of the chambers of the first plurality of chambers 46 or the second plurality of chambers 48. Grooves 52 reduce the overall weight of first manifold 12 by eliminating excess material disposed between each of chambers 46 of the first plurality of chambers 46 and the excess material disposed between each of chambers 48 of the second plurality of chambers 48.

Slots 66 can be formed in plate 26 such that each of slots 66 is positioned over one of grooves 52 and between chambers 46 of the first plurality of chambers and between chambers 48 of the second plurality of chambers 48. Slots 66 of plate 26 are not positioned over any chambers 46 of the first plurality of chambers 46 nor any chambers 48 of the second plurality of chambers 48. Similar to grooves 52, slots 66 reduce the overall weight of first manifold 12 by eliminating unnecessary material from plate 26.

FIGS. 4 and 5 best show the internal geometry of each chamber 46 of the first plurality of chambers 46 and the internal geometry of each chamber 48 of the second plurality of chambers 48. The first plurality of chambers 46 and the second plurality of chambers 48 are shown in phantom in FIG. 5. As shown in FIGS. 4 and 5, each chamber 46 of the first plurality of chambers 46 can include first opening 54, second opening 56, and top opening 58. First opening 54 of chamber 46 of the first plurality of chambers 46 can extend through bottom surface 40 of body 24 proximate where first side surface 42 meets bottom surface 40 of body 24. Second opening 56 of chamber 46 of the first plurality of chambers 46 can extend through bottom surface 40 of body 24 between the position of first opening 54 and partition 50.

Both first opening 54 and second opening 56 of chamber 46 of the first plurality of chambers 46 are sized and configured to each receive one end of one of mini-channel tubes 18 of heat exchanger core 16. Because first opening 54 and second opening 56 of chamber 46 of the first plurality of chambers are each configured to be connected to just one of mini-channel tubes 18, chamber 46 of the first plurality of chambers 46 is connected to no more than two of mini-channel tubes 18. As shown in FIG. 4, chamber 46 of the first plurality of chambers 46, along with first opening 54 and second opening 56, can be approximately equal in width as one of mini-channel tubes 18, width being defined as the dimension that extends parallel to the direction extending between first end 34 and second end 36 of body 24.

Top opening 58 of chamber 46 of the first plurality of chambers 46 can extend through top surface 38 of body 24 between first ridge 41 and partition 50. Top opening 58 of chamber 46 of the first plurality of chambers 46 can be formed as a byproduct of forming chamber 46 in body 24 by subtractive manufacturing, such as by machining. To aid in the manufacturing of the first plurality of chambers 46, first side surface 42 can extend from bottom surface 40 toward top surface 38 at angle $A_1$. Angle $A_1$ can be selected from the range of approximately 30 degrees to approximately 45 degrees. By selecting angle $A_1$ from the range of approximately 30 degrees to approximately 45 degrees, angle $A_1$ provides enough space between bottom surface 40, first side surface 42, and top surface 38 to allow machining tools, such as a rotary cutter, to adequately access the interior of body 24 to form each chamber 46 of the first plurality of chambers 46. Additionally, this angle range is optimal to best distribute the flow of fluid F from mini-channel tubes 18 through chamber 46 back into mini-channel tubes 18.

As shown in FIGS. 4 and 5, the internal geometry of second chamber 48 of the second plurality of chambers 48 can be mirror symmetric with the internal geometry of chamber 46 of the first plurality of chambers 46. Each chamber 48 of the second plurality of chambers 48 can include first opening 60, second opening 62, and top opening 64. First opening 60 of chamber 48 of the second plurality of chambers 48 can extend through bottom surface 40 of body 24 proximate where partition 50 meets bottom surface 40 of body 24. Second opening 62 of chamber 48 of the second plurality of chambers 48 can extend through bottom surface 40 of body 24 between the position of first opening 62 of chamber 48 of the second plurality of chambers 48 and partition 50.

Both first opening 60 and second opening 62 of chamber 48 of the second plurality of chambers 48 are sized and configured to each receive one end of one of mini-channel tubes 18 of heat exchanger core 16. Because first opening 60 and second opening 62 of chamber 48 of the second plurality of chambers are each configured to be connected to just one of mini-channel tubes 18, chamber 48 of the second plurality of chambers 48 is connected to no more than two of mini-channel tubes 48. As shown in FIG. 4, chamber 48 of the second plurality of chambers 48, along with first opening 60 and second opening 62 of chamber 48, can be approximately equal in width as one of mini-channel tubes 18, width being defined as the dimension that extends parallel to the direction extending between first end 34 and second end 36 of body 24.

Top opening 64 of chamber 48 of the second plurality of chambers 48 can extend through top surface 38 of body 24 between partition 50 and second ridge 43. Top opening 64 of chamber 48 of the second plurality of chambers 48 can be formed as a byproduct of forming chamber 48 in body 24 by subtractive manufacturing, such as by machining. To aid in the manufacturing of the second plurality of chambers 48, second side surface 44 can extend from bottom surface 40 toward top surface 38 at angle $A_2$. Angle $A_2$ can be selected from the range of approximately 30 degrees to approximately 45 degrees. By selecting angle $A_2$ from the range of approximately 30 degrees to approximately 45 degrees, angle $A_2$ provides enough space between bottom surface 40, second side surface 44, and top surface 38 to allow machining tools, such as a rotary cutter, to adequately access the interior of body 24 to form each chamber 48 of the second plurality of chambers 48. This angle range is optimal to best distribute the flow of fluid F from mini-channel tubes 18 through chamber 46 back into mini-channel tubes 18. Angel $A_1$ can be equal to angle $A_2$.

Once the first plurality of chambers 46 and the second plurality of chambers 48 are formed, plate 26 can be connected by brazing to top surface 38 of body 24 to cover and close each top opening 58 of the first plurality of chambers 46 and to cover and close each top opening 64 of the second plurality of chambers 48. Plate 26 can be a flat plate, or plate 26 can be curved so as to aid in counteracting any pressure stress that plate 26 my experience during operation of heat exchanger assembly 10.

Fluid channel 28 of first manifold 12 can extend generally parallel to body 24 with first end 68 of fluid channel 28 being disposed opposite second end 70 of fluid channel 28 (shown in FIG. 2A). As shown in FIG. 5, fluid channel bottom surface 72 can be continuous with the bottom surface of base plate 30 and bottom surface 40 of body 24. The plurality of openings 74 can be formed in fluid channel bottom surface 72. Each opening 74 of the plurality of openings 74 of fluid channel 28 can be configured to receive no more than one of mini-channel tubes 18, as shown in FIG. 5.

During operation of heat exchanger assembly 10 (shown in FIGS. 4 and 5), high pressure fluid F (which can be a gas or liquid) enters fluid channel 28 of first manifold 12. After entering fluid channel 28, fluid F is divided as fluid F flows through the plurality of openings 74 formed in fluid channel bottom surface 72. Fluid F then enters a row of mini-channel tubes 18 that are connected between fluid channel 28 of first manifold 12 and the second plurality of chambers 48 of second manifold 14. Because each of mini-channel tubes 18 connected to fluid channel 28 of first manifold 12 is connected to only one chamber 48 of the second plurality of chambers 48 of the second manifold 14, fluid F remains divided into separate streams as fluid F travels from fluid channel 28 across mini-channel tubes 18 and enters the second plurality of chambers 48 of second manifold 14. The separate streams of fluid F then travel respectively from the second plurality of chambers 48 of second manifold 14 into mini-channel tubes 18 connected between the second plurality of chambers 48 of second manifold 14 and the first plurality of chambers 46 of first manifold 12.

After the separate streams of fluid F enter the first plurality of chambers 46 of the first manifold 12 respectively, the separate streams of fluid F then travel respectively from the first plurality of chambers 46 of first manifold 12 into mini-channel tubes 18 connected between the first plurality of chambers 46 of first manifold 12 and the first plurality of chambers 46 of second manifold 14. Once the separate streams of fluid F enter the first plurality of chambers 46 of second manifold 14 respectively, the separate streams of fluid F then travel respectively from the first plurality of chambers 46 of second manifold 14 into mini-channel tubes 18 connected between the first plurality of chambers 46 of second manifold 14 and the second plurality of chambers 48 of first manifold 12.

After flowing across the second plurality of chambers 48 of first manifold 12, the separate streams of fluid F can then travel through a final row of mini-channel tubes 18 connected between the second plurality of chambers 48 of first manifold 12 and fluid channel 28 of second manifold 14. Once the separate streams of fluid F have traveled through the final row of mini-channel tubes 18, the separate streams of fluid F pass through the plurality of openings 74 of fluid channel 28 of second manifold 14 and enter the fluid channel 28 of second manifold 14. Inside fluid channel 28 of second manifold 14, the separate streams of fluid F join together again into a single flow stream before exiting fluid channel 28 of second manifold 14 and heat exchange assembly 10.

Because fluid F travels across first manifold 12 and second manifold 14 in separate streams in chambers 46 and 48 that are sized according to the size of mini-channel tubes 18, the amount of fluid F needed to fill first manifold 12, second manifold 14, and mini-channel tubes 18 is less than a conventional heat exchanger where the streams of fluid are rejoined in a larger common chamber every instance the fluid passes from the mini-channel tubes into a conventional manifold or header. By reducing the amount of fluid F needed to fill heat exchanger assembly 10, first manifold 12 and second manifold 14 reduce the overall operational weight of heat exchanger assembly 10 without changing the size of heat exchanger assembly 10. In applications such as aerospace of automotive vehicles, reducing the weight of a heat exchanger assembly will translate into overall weight reduction of a vehicle or aircraft and increased fuel economy.

In view of the foregoing description, it will be recognized that the present disclosure provides numerous advantages and benefits. For example, the present disclosure provides heat exchanger assembly 10 that requires less fluid volume than conventional heat exchanger assemblies of comparable size. First manifold 12 and second manifold 14 of heat exchanger assembly 10 also require less brazing during manufacturing than conventional heat exchanger assemblies because first manifold 12 and second manifold 14 each comprise only two components.

The following are non-exclusive descriptions of possible embodiments of the present invention.

In one embodiment, a manifold for a heat exchanger assembly includes a body and a plate. The body includes a first end disposed opposite a second end, and a top surface disposed opposite a bottom surface. The body also includes a first side surface extending between the top surface and the bottom surface, and a second side surface extending between the top surface and the bottom surface opposite the first side surface. A first plurality of chambers are formed in the body such that each chamber of the first plurality of chambers extends from the top surface to the bottom surface and extends between the first side surface and an intermediate plane disposed between the first side surface and the second side surface. Each chamber of the first plurality of chambers is also spaced apart from one another between the first end and the second end of the body. A second plurality of chambers is also formed in the body. Each chamber of the second plurality of chambers extends from the top surface to the bottom surface and extends between the second side surface and the intermediate plane. Each chamber of the second plurality of chambers is also spaced apart from one another between the first end and the second end of the body. The plate is disposed on the top surface of the body.

The manifold of the preceding paragraph can optionally include, additionally and/or alternatively, any one or more of the following features, configurations and/or additional components:

the top surface is parallel to the bottom surface, and the first side surface extends from the bottom surface toward the top surface at an angle selected from the range of approximately 30 degrees to approximately 45 degrees;

the second side surface extends from the bottom surface toward the top surface at an angle selected from the range of approximately 30 degrees to approximately 45 degrees;

each chamber of the first plurality of chambers comprises: a first opening extending through the bottom surface; and a second opening extending through the bottom surface, wherein the first opening of each chamber of the first plurality of chambers is configured to receive a mini-channel tube, and wherein the second opening of each chamber of the first plurality of chambers is configured to receive a mini-channel tube;

each chamber of the second plurality of chambers comprises: a first opening extending through the bottom surface; and a second opening extending through the bottom surface, wherein the first opening of each chamber of the second plurality of chambers is configured to receive a mini-channel tube, and wherein the second opening of each chamber of the second plurality of chambers is configured to receive a mini-channel tube;

each chamber of the first plurality of chambers is aligned with a chamber of the second plurality of chambers between the first side surface and the second side surface;

the body of the manifold further comprises: a plurality of grooves formed in the top surface of the body such that each groove extends from the first side surface to the second side surface, wherein each groove of the plurality of grooves is disposed between two chambers of the first plurality of chambers and two chambers of the second plurality of chambers;

the plate comprises: a plurality of slots formed in the plate, wherein each slot of the plurality of slots is positioned over one groove of the plurality of grooves; and/or a heat exchanger assembly comprising the manifold, wherein the heat exchanger assembly comprises: a second manifold of similar configuration to the manifold disposed opposite the manifold such that the bottom surface of the manifold faces a bottom surface of the second manifold; and a plurality of mini-channel tubes extending between the manifold and the second manifold, wherein each chamber of the first plurality of chambers of the manifold is connected to no more than two mini-channel tubes of the plurality of mini-channel tubes, and wherein each chamber of the second plurality of chambers of the manifold is connected to no more than two mini-channel tubes of the plurality of mini-channel tubes.

In another embodiment, a manifold for a heat exchanger assembly includes a body having a first end disposed opposite a second end and a top surface disposed opposite a bottom surface. The body further includes a first side surface extending between the top surface and the bottom surface and a second side surface extending between the top surface and the bottom surface opposite the first side surface. A first plurality of chambers is formed in the body such that each chamber of the first plurality of chambers extends from the bottom surface towards the top surface and extends between the first side surface and an intermediate plane disposed between the first side surface and the second side surface. Each chamber of the first plurality of chambers is also spaced apart from one another between the first end and the second end of the body. A second plurality of chambers is also formed in the body. Each chamber of the second plurality of chambers extends from the bottom surface towards the top surface and extends between the second side surface and the intermediate plane. Each chamber of the second plurality of chambers is also spaced apart from one another between the first end and the second end of the body.

The manifold of the preceding paragraph can optionally include, additionally and/or alternatively, any one or more of the following features, configurations and/or additional components:

each chamber of the first plurality of chambers and each chamber of the second plurality of chambers extends through both the top surface and the bottom surface of the body;

the manifold further comprises: a plate disposed on the top surface of the body;

each chamber of the first plurality of chambers is configured to be connected to no more than two mini-channel tubes proximate the bottom surface, and each chamber of the second plurality of chambers is configured to be connected to no more than two mini-channel tubes proximate the bottom surface;

a fluid channel extending generally parallel to the body, wherein the fluid channel comprises: a first end disposed opposite a second end; a fluid channel bottom surface; and a plurality of openings formed in the fluid channel bottom surface, wherein each opening of the plurality of openings is configured to receive no more than one mini-channel tube; and/or the manifold further comprises: a first fitting connected to the first end of the fluid channel; and a second fitting connected to the second end of the fluid channel.

Any relative terms or terms of degree used herein, such as "substantially", "essentially", "generally", "approximately", and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transitory vibrations and sway movements, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. For example, while FIGS. 1-5 show first manifold 12 and second manifold 14 each comprising plate 26 to cover top openings 58 and 64 of the first plurality of chambers 46 and the second plurality of chambers 48 respectively, first manifold 12 and second manifold 14 can each be manufactured through additive manufacturing or any other process such that the first plurality of openings 46 and the second plurality of openings 48 extend from bottom surface 40 of body 24 toward top surface 38 of body 24 without extending through top surface 38. By thus manufacturing first manifold 12 and second manifold 14, plate 26 can be eliminated from first manifold 12 and second manifold 14 without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A manifold for a heat exchanger assembly, the manifold comprising:

a body comprising:

a first end disposed opposite a second end;

a top surface disposed opposite a bottom surface;

a first side surface extending between the top surface and the bottom surface;

a second side surface extending between the top surface and the bottom surface opposite the first side surface;

a first plurality of chambers formed in the body, wherein each chamber of the first plurality of chambers extends from the top surface to the bottom surface and extends between the first side surface and an intermediate plane disposed between the first side surface and the second side surface, and wherein each chamber of the first plurality of chambers is spaced apart from one another between the first end and the second end of the body; and a second plurality of chambers formed in the body, wherein each chamber of the second plurality of chambers extends from the top surface to the bottom surface and extends between the second side surface and the intermediate plane, and wherein each chamber of the second plurality of chambers is spaced apart from one another between the first end and the second end of the body, wherein the top surface is parallel to the bottom surface, and the first side surface extends from the bottom surface toward the top surface at an angle selected from the range of approximately 30 degrees to approximately 45 degrees; and a plate disposed on the top surface of the body.

2. The manifold of claim 1, wherein the second side surface extends from the bottom surface toward the top surface at an angle selected from the range of approximately 30 degrees to approximately 45 degrees.

3. The manifold of claim 1, wherein each chamber of the first plurality of chambers comprises:

a first opening extending through the bottom surface; and a second opening extending through the bottom surface, wherein the first opening of each chamber of the first plurality of chambers is configured to receive a mini-channel tube, and wherein the second opening of each chamber of the first plurality of chambers is configured to receive a mini-channel tube.

4. The manifold of claim 3, wherein each chamber of the second plurality of chambers comprises:

a first opening extending through the bottom surface; and a second opening extending through the bottom surface, wherein the first opening of each chamber of the second plurality of chambers is configured to receive a mini-channel tube, and wherein the second opening of each chamber of the second plurality of chambers is configured to receive a mini-channel tube.

5. The manifold of claim 4, wherein each chamber of the first plurality of chambers is aligned with a chamber of the second plurality of chambers between the first side surface and the second side surface.

6. The manifold of claim 5, wherein the body of the manifold further comprises:

a plurality of grooves formed in the top surface of the body such that each groove extends from the first side surface to the second side surface, wherein each groove of the plurality of grooves is disposed between two chambers of the first plurality of chambers and two chambers of the second plurality of chambers.

7. The manifold of claim 6, wherein the plate comprises:

a plurality of slots formed in the plate, wherein each slot of the plurality of slots is positioned over one groove of the plurality of grooves.

8. A heat exchanger assembly comprising the manifold of claim 1, wherein the heat exchanger assembly comprises:

a second manifold disposed opposite the manifold such that the bottom surface of the manifold faces a bottom surface of the second manifold; and a plurality of mini-channel tubes extending between the manifold and the second manifold, wherein each chamber of the first plurality of chambers of the manifold is connected to no more than two mini-channel tubes of the plurality of mini-channel tubes, and wherein each chamber of the second plurality of chambers of the manifold is connected to no more than two mini-channel tubes of the plurality of mini-channel tubes.

9. A manifold for a heat exchanger assembly, the manifold comprising:

a body comprising:

a first end disposed opposite a second end;

a top surface disposed opposite a bottom surface;

a first side surface extending between the top surface and the bottom surface;

a second side surface extending between the top surface and the bottom surface opposite the first side surface;

a first plurality of chambers formed in the body, wherein each chamber of the first plurality of chambers extends from the bottom surface towards the top surface and extends between the first side surface and an intermediate plane disposed between the first side surface and the second side surface, and wherein each chamber of the first plurality of chambers is spaced apart from one another between the first end and the second end of the body; and a second plurality of chambers formed in the body, wherein each chamber of the second plurality of chambers extends from the bottom surface towards the top surface and extends between the second side surface and the intermediate plane, and wherein each chamber of the second plurality of chambers is spaced apart from one another between the first end and the second end of the body, wherein the top surface is parallel to the bottom surface, and the first side surface extends from the bottom surface toward the top surface at an angle selected from the range of approximately 30 degrees to approximately 45 degrees.

10. The manifold of claim 9, wherein each chamber of the first plurality of chambers and each chamber of the second plurality of chambers extends through both the top surface and the bottom surface of the body.

11. The manifold of claim 10, wherein the manifold further comprises:

a plate disposed on the top surface of the body.

12. The manifold of claim 11, wherein each chamber of the first plurality of chambers is configured to be connected to no more than two mini-channel tubes proximate the bottom surface, and each chamber of the second plurality of chambers is configured to be connected to no more than two mini-channel tubes proximate the bottom surface.

13. The manifold of claim 12, wherein the manifold further comprises:

a fluid channel extending generally parallel to the body, wherein the fluid channel comprises:

a first end disposed opposite a second end;

a fluid channel bottom surface; and a plurality of openings formed in the fluid channel bottom surface, wherein each opening of the plurality of openings is configured to receive no more than one mini-channel tube.

14. The manifold of claim 13, wherein the manifold further comprises:

a first fitting connected to the first end of the fluid channel; and a second fitting connected to the second end of the fluid channel.

* * * * *